US007472802B2

(12) United States Patent
van Riel

(10) Patent No.: US 7,472,802 B2
(45) Date of Patent: Jan. 6, 2009

(54) SYSTEM FOR KEEPING A DISPENSING APPARATUS FOR A ZIGZAG FOLDED WEB OF TOWEL MATERIAL OPTIMALLY FILLED

(75) Inventor: Elisabeth Joanna van Riel, Tilburg (NL)

(73) Assignee: Vendor B.V., Tilburg (NL)

( * ) Notice: Subject to any disclaimer, the term of this patent is extended or adjusted under 35 U.S.C. 154(b) by 351 days.

(21) Appl. No.: 11/048,631

(22) Filed: Feb. 1, 2005

(65) Prior Publication Data

US 2005/0189850 A1 Sep. 1, 2005

(30) Foreign Application Priority Data

Feb. 2, 2004 (NL) ..... 1025382

(51) Int. Cl.
*A47K 10/34* (2006.01)

(52) U.S. Cl. ..... 221/6; 221/33; 221/36; 221/43; 221/155; 312/34.4

(58) Field of Classification Search ..... 700/231–244; 221/1–312 C; 312/34.4
See application file for complete search history.

(56) References Cited

U.S. PATENT DOCUMENTS 4,535,912 A * 8/1985 Bonk ..... 221/46
4,776,649 A * 10/1988 ten Wolde ..... 312/34.6
5,033,620 A * 7/1991 De Luca ..... 206/494
5,390,820 A * 2/1995 Wright et al. ..... 221/52
5,540,354 A * 7/1996 Annand ..... 221/52
6,422,416 B1 * 7/2002 Tramontina ..... 221/45
6,644,499 B2 * 11/2003 Tramontina ..... 221/45
6,877,634 B2 * 4/2005 Tramontina et al. ..... 221/53
7,048,143 B2 * 5/2006 Sanders et al. ..... 221/46

* cited by examiner

*Primary Examiner*—Gene Crawford
*Assistant Examiner*—Michael K Collins
(74) *Attorney, Agent, or Firm*—Weingarten, Schurgin, Gagnebin & Lebovici LLP

(57) ABSTRACT

A system for optimally filling an apparatus for dispensing a zigzag folded web of towel material is provided. The system includes a holder that is disposed in a housing for receiving a first stock of zigzag folded web of towel material. The holder also includes a fill meter having a division into at least three areas each having its own coding. The first upper coding indicates that no refilling is required, a second coding below the first indicates that refilling with a refill stock that has a coding equal to the second coding, and each further coding indicates refilling with an increasingly thicker refill stock that has a corresponding coding.

34 Claims, 2 Drawing Sheets

SYSTEM FOR KEEPING A DISPENSING APPARATUS FOR A ZIGZAG FOLDED WEB OF TOWEL MATERIAL OPTIMALLY FILLED

This application claims priority to a Dutch application No. NL 1025382 filed Feb. 2, 2004.

The invention relates to a system for keeping a dispensing apparatus for a zigzag folded web of towel material optimally filled, which system is provided with a holder, included in a housing, for receiving a stock of zigzag folded web of towel material, which, on the one side, runs from the holder to a space of use and, on the other side, has an end that is connectable with a first free end of a correspondingly zigzag folded web of towel material forming a refill stock, and to a dispensing apparatus for towel material and a refill stock of towel material.

Such a system is known from European patent 0 107 223 jointly in the name of applicant. One of the advantages of such a system compared to likewise known systems in which use is made of a web of towel material rolled into a roll is that the refilling can either take place more efficiently or, thus, all towel material can effectively be utilized.

More efficient refilling is obtained in that, for carrying out a refill action, one does not need to wait until all the towel material in stock has been used up, as is the case with a roll. This is because a new stock can be placed on a partly used stock and be connected thereto. With an almost depleted roll-shaped stock, before being able to place a new roll, one will need to wait until the roll has been used up completely and will therefore need to check several times at short intervals. This is laborious, time-consuming and expensive. Therefore, this will soon result in an almost depleted roll being replaced by a new roll and, consequently, a part of the towel material of the old roll being removed without having been used.

However, the use of towel material can vary considerably during equal, successive periods. During periods that less towel material is used up, checking will therefore still need to take place regularly, since the checking intervals are in effect to be adjusted to a maximum period of use.

In a system of the type intended in the introduction, the invention contemplates quickly and simply providing the possibility to keep a dispenser apparatus optimally filled and to thus better control the time intervals between successive refilling operations.

This is achieved in a system according to the invention if the holder is provided with a fill meter with, in thickness direction of the stock of zigzag folded web of towel material, a division into at least three areas each having its own coding, with a first upper coding in the thickness direction indicating that no refilling is required, a second coding following the first indicating refilling with a refill stock provided with a coding equal to the second coding and each further coding indicating refilling with an increasingly thicker refill stock with corresponding coding. By these measures, refill stocks are made available in at least two designs, which mutually differ with respect to their thickness, that is, the number of zigzag folded layers laying on top of one another, so that, depending on the amount of towel material of the stock in the holder that is used up, a thickness can be chosen with which the replenished stock in the holder approaches a maximum stock allowed therein as closely as possible. Here, due to the coding, it can be observed and determined at a single glance which design of the refill stock should be chosen, so that, due to the simplicity, virtually untrained personnel can also quickly and reliably carry out the refilling in the desired manner, because the ease of use is enhanced considerably. Thus, by choosing the thicknesses of the different designs of the refill stocks in a suitable manner, it will happen less often that the dispensing apparatus is checked without this leading to refilling, so that it is also effected then that, on average the dispensing apparatus will always have a relatively high degree of filling or, in other words, a smaller chance of the stock of towel material in the holder becoming depleted, which, in turn, offers possibilities for optimization, that is, control of the interval between two inspections of the dispensing apparatus. These possibilities may be a moment fixed in time at which inspection takes place or a moment determined by certain events, for instance just before the interval during a theater performance.

The inspection action can be accelerated still further and, thereby be made more efficient if, according to a further embodiment of the invention, the thickness of the stock of zigzag folded towel material in the holder is monitored by an element suitable for this purpose, which element is in controlling connection with an indicating element that makes the refilling need visible without needing to open the housing by indicating the respective coding. Thus, at a glance from a distance, it can be determined whether refill stock is desired, and if so, what design, to keep the dispensing apparatus optimally filled.

The codings may have any desired shape, such as numbers, pictograms, hatchings, corrugations and other thickenings or recesses, or three-dimensional indications. According to a further embodiment of the invention, however, it is preferred that the codings consist of mutually different colors, since these yield the smallest chance of mistakes and are, in particular, clearly visible from a distance as well.

It goes without saying that, the more different designs of refill stock with different thicknesses are available, the higher the average degree of filling of the dispensing apparatus can be if, at least, inspection takes place sufficiently often, which is precisely not the intention. Many designs further also means large stocks both in a supply room and during an inspection round. From practical experiences, it is therefore preferred that three different codings are present, which may be color codings, with the second coding being characterized by the color orange and the third coding by the color red, while the first coding may be a neutral color, such as white, transparent, the color of the holder or the color of the housing, or is formed by a transparent element.

The invention further relates to a dispensing apparatus for use in a system according to the invention. For this purpose, according to the invention, it is proposed for a dispensing apparatus provided with a holder for a stock of zigzag folded web of towel material included in a housing, as known from the above-mentioned European patent 0 107 223 that, in thickness direction of the stock of zigzag folded web of towel material, the holder is provided with a fill meter with a division into at least three areas each having its own coding, with a first upper coding in the thickness direction indicating that no refilling is required, a second coding following the first indicating refilling with a refill stock provided with a coding equal to the second coding and each further coding indicating refilling with an increasingly thicker refill stock with corresponding coding. Thus, a known dispensing apparatus could be made suitable for the system according to the invention by providing a fill meter, for instance in the form of a sticker.

In order to be able to assess the degree of filling quickly and even from a distance, according to a further embodiment of the invention, it is provided that the holder is provided with an element that monitors the thickness of the stock of zigzag folded web of towel material and is in connection with an indicating device for the degree of filling that is readable from outside the housing. Here, the codings are preferably again three in number and designed as colors, more in particular orange and red for the second and third coding and a more neutral color for the first coding.

The element for monitoring the thickness of the stock of zigzag folded towel material in the holder can be realized relatively simply yet reliably if it is designed as a feeler being in contact with the topside of that stock, which feeler is further preferably mechanically connected with an indicating element which makes a refill coding visible via an inspection window in the casing. Here, the indicating element can be realized in various manners such as for instance a strip provided with codings which is slid along an inspection window or as a pivot lever which carries different codings on different radii and, depending on the degree of filling, pivots a particular coding via an inspection window intended for that coding.

The invention further relates to a refill stock which is to be used in a system or a dispensing apparatus according to the invention, as discussed hereinabove, and which consists of a web of zigzag folded towel material with, at both ends of the web, a free end which is couplable with a free end of a partly used stock or a further refill stock, as known from the above-mentioned patent 0 107 223, which refill stock is, according to the invention, characterized by a coding which is a measure for the thickness and corresponds with one of the codings of the system or the dispensing apparatus. Further, there is a preference for the coding being a color, more in particular orange or red, which has been provided on the towel material, the coupling provisions at a free end, a packaging of the stock of towel material and/or a packaging around a number of stocks of towel material.

With reference to the embodiments shown in the Figures, but exclusively by way of non-limitative examples, the invention will now be clarified. In the drawing.

Figure 1:
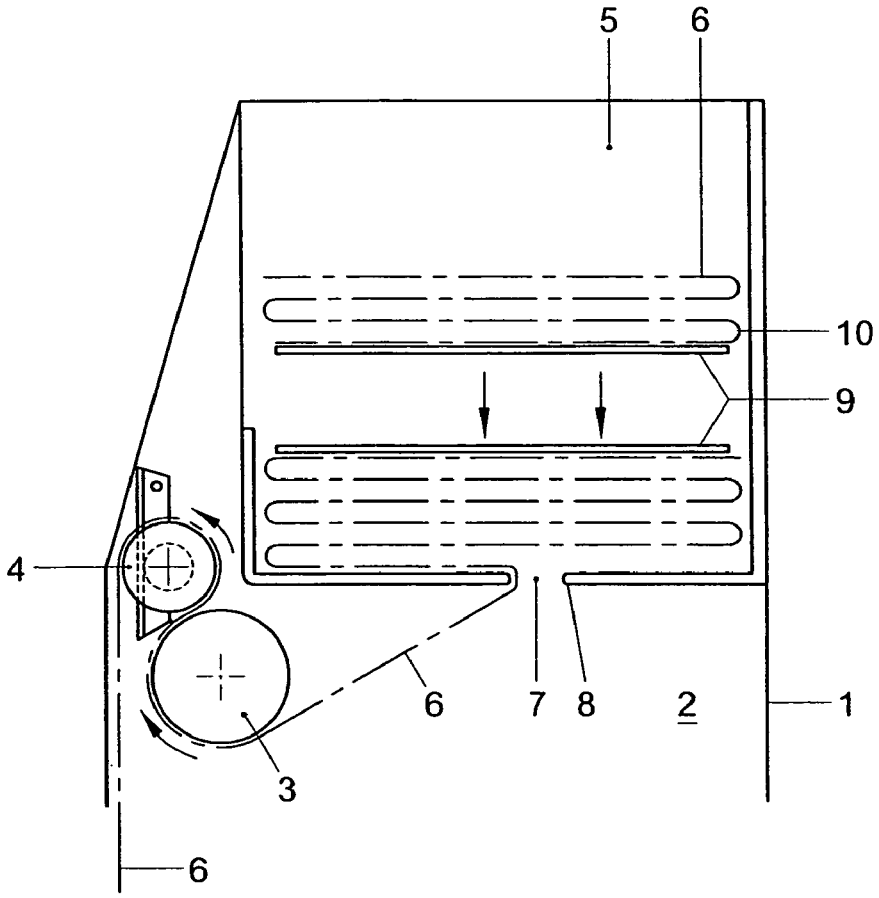
FIG. 1 shows a cross-sectional view of a part of a dispensing apparatus for a zigzag folded web of towel material.

The dispensing apparatus partly shown in FIG. 1 is provided with a back wall 1, by which the dispensing apparatus can be suspended from, for instance, a wall. To the back wall 1, two side walls 2 connect, between which a first and a second dispensing rollers 3 and 4 are mounted. In the dispensing apparatus, further, a holder 5 is provided which is intended for receiving a stock of towel material in the form of a zigzag folded web 6, which leaves the holder 5 via a slot 7 in bottom wall 8 to then run around the dispensing rollers 3 and 4 to a dispensing position directed vertically downwards. There, an access opening is provided in a cover not shown in FIG. 1, via which the web 6 of towel material can be used for drying the hands. The used web can be torn off and thrown away or, as known from European patent 0 107 223, be rolled up around a receiving axle, whose rotation is coupled with those of the rollers 3 and 4. The web 6 may be manufactured from any suitable material, such as optionally reinforced paper, textile, etc.

After use of a certain amount, the stock of towel material in the holder 5 can be replenished by introducing a refill stock 10 into the holder 5 and connecting this refill stock 10 with the stock present in the holder 5. For this purpose, the free end of the zigzag folded web 6 forming the stock present in the holder 5 is provided with a glue strip covered by a strip 9. The free web ends of the refill stock 10 are designed in a similar manner. If the holder 5 needs to be refilled, then the cover sheet 9 is torn off the stock present in the holder 5, as is one of the cover sheets 9 of the refill stock 10. By now introducing the refill stock 10 into the holder 5 such that the cleared glue strips contact each other, a continuous dispensation of the web 6 of towel material is guaranteed.

Figure 2:
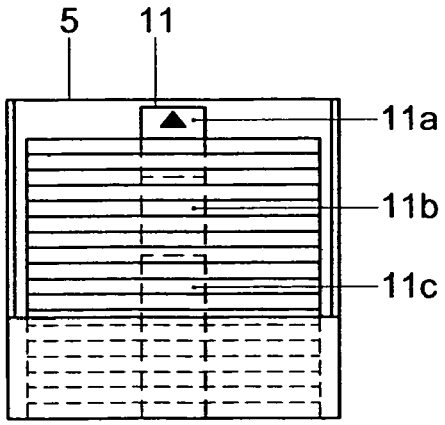
FIG. 2 shows the holder according to FIG. 1 in virtually completely filled condition.
Figure 3:
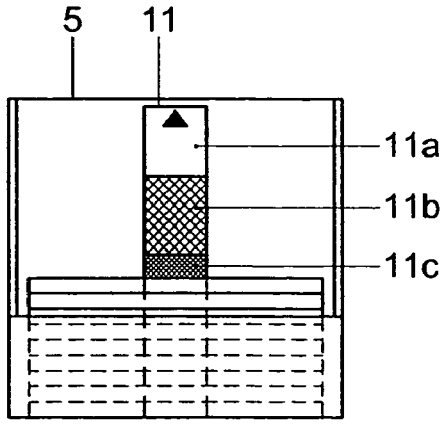
FIG. 3 shows the holder according to FIG. 1 in virtually completely empty condition.

In order to keep the holder 5 filled as optimally as possible in a quickly observable and simple manner, on the right side wall of the holder 5 shown in FIG. 1, a fill meter 11 is provided, which is shown in FIGS. 2 and 3, which show a front view of the holder 5 in different filling positions.

In FIG. 2, the holder 5 contains a stock of towel material in the form of a zigzag folded web, which stock fills the holder 5 to virtually the arrow on the fill meter 11, which arrow indicates the maximum filling level. In height direction, the fill meter is divided into three areas, which can best be seen in FIG. 3. A first upper area 11*a* has a neutral color, for instance white or the color of the holder if it is not white. A second area 11*b* is filled with the color orange (grey in the black-and-white Figure) and a third area 11*c* with the color red (black in the black-and-white Figure).

In the situation of FIG. 2, upon opening the cover, the area 11*a* with the neutral color will be visible above the stock of towel material. This is a sign that refilling should not take place. If more towel material has been used up, so that the thickness of the stock of towel material in the holder 5 has been reduced such that the orange area 11*b* is visible above that stock, this is a sign that a refill stock having a first thickness and provided with an orange coding can be placed to optimize the stock of towel material in the holder 5 again. If, in the time interval between two inspections of the stock of towel material, the dispensing apparatus has been used more intensively, then the stock of towel material can be reduced so much that the red area 11*c* is visible above that stock of towel material. This is a sign that a refill stock having a second thickness and provided with a red coding needs to be placed to optimize the stock of towel material in the holder 5 again.

Thus, a system is provided with which the number of inspections of the dispensing apparatus can be reduced. This is because, only when using stocks having a thickness corresponding to that of the red-coded stock in the case when the orange area is visible, refilling cannot take place and an extra inspection would be necessary to prevent the dispensing apparatus from undesirably becoming empty. In the present filling system according to the invention, the time interval between two inspections can remain adjusted to the maximum use of the towel material because, if considerably less than the maximum has been used up during this period, then the stock can be optimized again with an orange refill stock, so that an intermediate inspection does not need to take place.

As coding of the refill stocks, the colors orange and red have been discussed. It goes without saying that these can also be different colors, and that codings differing from colors may also be used, for instance number codes, hatchings and the like.

In order to be able to determine the refilling need more quickly, more in particular from a distance and without needing to open the dispensing apparatus, an indicating mechanism readable from the outside can be provided. Two of such mechanisms are shown in FIGS. 4 and 5, respectively.

Figure 4:
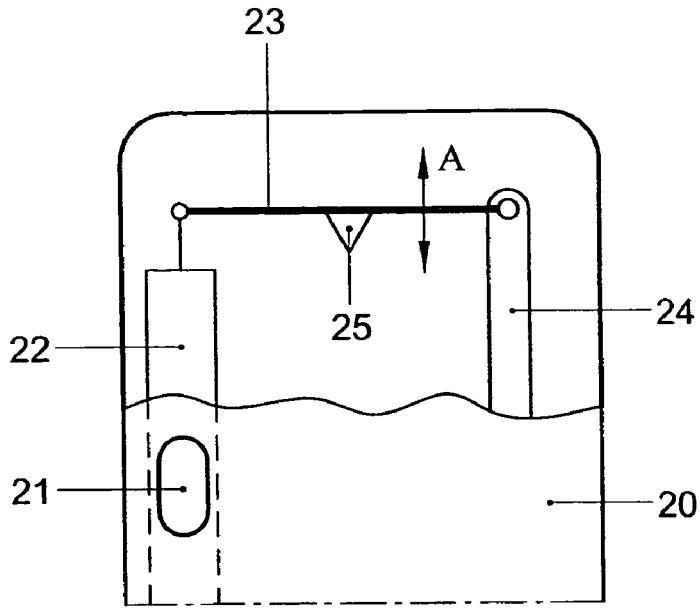
FIG. 4 shows, in front view, a part of a dispensing apparatus with partly cutaway cover and provided with a first indicating mechanism indicated schematically.

FIG. 4 shows a part of a dispensing apparatus in front view, where a part of a cover 20 has been cut away. In the non-cutaway part of the cover 20, an inspection screen 21 is present, behind which a strip 22 slidable in vertical direction is present that is provided with codings corresponding with degrees of filling of the holder 5 to be read out. Sliding of the strip 22 takes place by means of coupling with a rod 23 which is movable in vertical direction as designated by a double arrow A and while guided by a guide 24. During the use of towel material, the downward movement of the rod 23 is controlled by a feeler element 25, which is in contact with the topside of the stock of towel material in the holder in a manner not shown. When the rod 23 is lowered, the strip 22 also slides along the inspection window 21 and thus shows a coding corresponding with the degree of filling of the holder 5.

Figure 5:
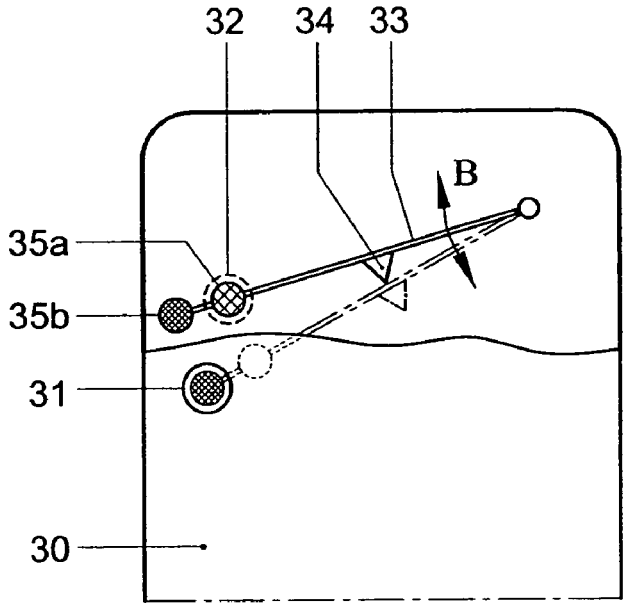
FIG. 5 shows, in front view, a part of a dispensing apparatus with partly cutaway cover and provided with a second indicating mechanism indicated schematically.

FIG. 5 shows a part of a dispensing apparatus in front view, where a part of a cover 30 has been cut away. In the non-cutaway part of the cover 30, an inspection screen 31 is present. In the cutaway part of the cover 30, further, a second inspection screen 32 is present, designated by a dashed line. Further, a rod 33 pivotable in the direction of the double arrow B is provided, which rod 33 carries a feeler element 34 and two indicators 35*a* and 35*b*, with the indicator 35*b* being located further from the pivot point of the rod 33 than the indicator 35*a*. The inspection windows 31 and 32 have been placed such that, in a particular pivoting area, the indicator 35*a* is visible in the inspection window 32, while the indicator 35*b* is not visible through any window, which situation is shown in FIG. 5. The pivoting of the rod 33 is controlled by the feeler element 34 that is in contact with the topside of the stock of towel material in the holder 5. If more towel material is used up, the rod 33 will pivot further downwards, while the indicator 35*b* becomes visible through the inspection window 31. The indicator 35*b* may again have a red color, while the indicator 35*a* may be orange.

The coding of the refill stocks can take place in many manners. Possibilities are, for instance, providing a coding, such as a color, on or in the towel material. Such a coding may also be present in the cover sheet or the glue layer covered thereby or be expressed in an arrow indicating the sliding direction of a refill stock into the holder. However, it will often be preferred to provide the coding on a packaging of the refill stock and on a box in which a number of refill stocks are stored and transported.

It goes without saying that, within the framework of the invention as set forth in the appended claims, many other modifications and variations are possible. For instance, a fill meter may be divided into more than three areas, where, for each extra area, a refill stock needs to be available to keep the dispensing apparatus optimally filled. For monitoring the degree of filling of the holder, many different methods are possible in addition to mechanically monitoring the topside of the stock. One possibility is optically determining when the stock passes an area boundary on the fill meter. It is also possible, with the aid of measuring the weight of the stock, to determine the degree of filling and the corresponding, predetermined coding and to make them visible on the outside of the dispensing apparatus.

The invention claimed is:

1. A system for optimally filling an apparatus for dispensing a zigzag folded web of towel material, the system comprising:

a holder that is disposed in a housing, for receiving a first stock of zigzag folded web of towel material, which zigzag folded web of towel material, on one side thereof, runs from the holder to a space of use and, on another side thereof, has an end that is connectable with a first free end of a subsequent stock of zigzag folded web of towel material forming a refill stock, wherein each zigzag folded web of towel material has a thickness with a thickness direction oriented from said one side to said another side, and wherein the holder is provided with a fill meter having a division in a thickness direction of each stock of zigzag folded web of towel material, of at least three areas, each area having its own coding:

a first, upper coding in said thickness direction indicating that no refilling is required, a second coding following the first, upper coding indicating refilling with a refill stock provided with a refill coding corresponding to the second coding, and at least one further coding indicating refilling with an increasingly thicker refill stock having a refill coding corresponding to the at least one further coding.

2. A system according to claim 1, characterized in that the thickness of the stock of zigzag folded towel material in the holder is monitored by an element suitable for this purpose, which element is in controlling connection with an indicating element that makes the refilling need visible without needing to open the housing by indicating the respective coding.

3. A system according to claim 1, characterized in that the codings consist of mutually different colors.

4. A system according to claim 1, characterized in that three different codings are present.

5. A system according to claim 3, characterized in that the second coding is characterized by the color orange and the at least one further coding by the color red.

6. A system according to claim 5, characterized in that the first coding is a neutral color, such as white, transparent, the color of the holder or the color of the housing.

7. A system according to claim 2, characterized in that the element for monitoring the height of the stock of zigzag folded towel material in the holder is a feeler being in contact with the topside of that stock.

8. A system according to claim 7, characterized in that the feeler is mechanically connected with an indicating element which makes the first, second, and the at least one further codings visible via an inspection window in the housing.

9. A system according to claim 8, characterized in that the indicating element is a strip provided with the first, second, and the at least one further codings which is slid along an inspection window.

10. A system according to claim 8, characterized in that the indicating element is a pivot lever carrying different codings on different radii and pivots a particular coding via an inspection window provided for that coding, depending on the degree of filling.

11. An optimally-fillable system for dispensing towel material, the system comprising:

a zigzag folded web of towel material having a thickness and a thickness direction oriented from said one side to said another side, the zigzag folded web of towel material being arranged in coded refill stocks;

a holder disposed in a housing for holding a first stock of zigzag folded web towel material, the holder including a fill meter having a division, in the thickness direction of each stock of zigzag folded web of towel material, of at least three areas, each area having its own coding:

a first, upper coding in said thickness direction indicating that no refilling is required, a second coding following the first, upper coding indicating refilling with a refill stock provided with a coded refill stock corresponding to the second coding, and at least one further coding indicating refilling with an increasingly thicker refill stock having a corresponding refill coding of the at least one further coding.

12. A dispensing apparatus according to claim 11, characterized in that the holder is provided with an element that monitors the thickness of the stock of zigzag folded towel material in the holder and is in connection with an indicating device for the degree of filling which can be read out from outside the housing.

13. A dispensing apparatus according to claim 11, characterized in that the areas are marked by mutually different colors.

14. A dispensing apparatus according to claim 13, characterized in that the second coding is formed by the color orange and the at least one further coding by the color red.

15. A dispensing apparatus according to claim 14, characterized in that the first coding is formed by a neutral color, such as white, transparent, the color of the holder or the color of the housing.

16. A dispensing apparatus according to claim 12, characterized in that the element for monitoring the thickness of the stock of zigzag folded towel material in the holder is a feeler being in contact with the topside of that stock.

17. A dispensing apparatus according to claim 16, characterized in that the feeler is mechanically connected with an indicating element which makes the first, second, and the at least one further codings visible via an inspection window in the housing.

18. A dispensing apparatus according to claim 17, characterized in that the indicating element is a strip provided with the first, second, and the at least one further codings which is slid along an inspection window.

19. A dispensing apparatus according to claim 17, characterized in that the indicating element is a pivot lever carrying different codings on different radii and pivots a particular coding via an inspection window provided for that coding, depending on the degree of filling.

20. A refill stock to be used in a system or a dispensing apparatus according to claim 1 and consisting of a web of zigzag folded towel material with, at both ends of the web, a free end which is couplable with a free end of a partly used stock or a further refill stock and is characterized by a refill coding which is a measure for the thickness and corresponds with one of the first, second, and the at least one further codings of said system or said dispensing apparatus.

21. A refill stock according to claim 20, characterized in that the refill coding is a color provided on or in the towel material, the coupling provisions at a free end, a packaging of the stock of towel material and/or a packaging around a number of stocks of towel material.

22. A refill stock according to claim 21, characterized in that the color is orange.

23. A refill stock according to claim 21, characterized in that the color is red.

24. A system according to claim 2, characterized in that:

three different codings are present;

the codings consist of mutually different colors and that the second coding is characterized by the color orange and the at least one further coding by the color red;

the first coding is a neutral color, such as white, transparent, the color of the holder or the color of the housing;

the element for monitoring the height of the stock of zigzag folded towel material in the holder is a feeler being in contact with the topside of that stock;

the feeler is mechanically connected with an indicating element which makes at lease one of the first, second, and the at least one further codings visible via an inspection window in the housing;

the indicating element is one of a strip provided with the first, second, and the at least one further codings which is slid along an inspection window and a pivot lever carrying different codings on different radii and pivots a particular coding via an inspection window provided for that particular coding, depending on the degree of filling.

25. A dispensing apparatus to be used in a system according to claim 24 and provided with a holder included in a housing for a stock of zigzag folded towel material, which holder is provided with a fill meter with, in thickness direction of the stock of zigzag folded web of towel material, a division into at least three areas each having its own coding, with a first upper coding in said thickness direction indicating that no refilling is required, a second coding following the first indicating refilling with a refill stock provided with a refill coding equal to the second coding and each further coding indicating refilling with an increasingly thicker refill stock with corresponding refill coding.

26. A dispensing apparatus according to claim 25, characterized in that:

the holder is provided with an element that monitors the thickness of the stock of zigzag folded towel material in the holder and is in connection with an indicating device for the degree of filling which can be read out from outside the housing;

the areas are marked by mutually different colors;

the second coding is formed by the color orange and the at least one further coding by the color red;

the first coding is formed by a neutral color, such as white, transparent, the color of the holder or the color of the housing;

the element for monitoring the thickness of the stock of zigzag folded towel material in the holder is a feeler being in contact with the topside of that stock;

the feeler is mechanically connected with an indicating element which makes at least one of the first, second, and the at least one further codings visible via an inspection window in the housing;

the indicating element is one of a strip provided with the first, second, and the at least one further codings which is slid along an inspection window and a pivot lever carrying different codings on different radii and pivots a particular coding via an inspection window provided for that particular coding, depending on the degree of filling.

27. A refill stock to be used in a system or a dispensing apparatus according to claim 24 and consisting of a web of zigzag folded towel material with, at both ends of the web, a free end which is couplable with a free end of a partly used stock or a further refill stock and is characterized by a refill coding which is a measure for the thickness and corresponds with one of the first, second, and the at least one further codings of said system or said dispensing apparatus.

28. A refill stock to be used in a system or a dispensing apparatus according to claim 25 and consisting of a web of zigzag folded towel material with, at both ends of the web, a free end which is couplable with a free end of a partly used stock or a further refill stock and is characterized by a refill coding which is a measure for the thickness and corresponds with one of the first, second, and the at least one further codings of said system or said dispensing apparatus.

29. A refill stock to be used in a system or a dispensing apparatus according to claim 26 and consisting of a web of zigzag folded towel material with, at both ends of the web, a free end which is couplable with a free end of a partly used stock or a further refill stock and is characterized by a refill coding which is a measure for the thickness and corresponds with one of the first, second, and the at least one further codings of said system or said dispensing apparatus.

30. A refill stock according to claim 22, characterized in that the refill coding is a color selected from the group consisting of orange and red provided on or in the towel material, the coupling provisions at a free end, a packaging of the stock of towel material and/or a packaging around a number of stocks of towel material.

31. A refill stock according to claim 28, characterized in that the refill coding is a color selected from the group consisting of orange and red provided on or in the towel material, the coupling provisions at a free end, a packaging of the stock of towel material and/or a packaging around a number of stocks of towel material.

32. A refill stock according to claim 29, characterized in that the refill coding is a color selected from the group consisting of orange and red provided on or in the towel material, the coupling provisions at a free end, a packaging of the stock of towel material and/or a packaging around a number of stocks of towel material.

33. A system for optimally filling an apparatus for dispensing a zigzag folded web of towel material, the system comprising:

a holder that is disposed in a housing, for receiving a first stock of zigzag folded web of towel material, which zigzag folded web of towel material, on the one side thereof, runs from the holder to a space of use and, on another side thereof, has an end that is connectable with a first free end of a subsequent stock of zigzag folded web of towel material forming a refill stock, wherein the zigzag folded web of towel material has a thickness and a thickness direction oriented from said one side to said another side, and wherein the holder is provided with a fill meter having a division, in the thickness direction of each stock of zigzag folded web of towel material, of at least three areas, each area having its own coding:

a first, upper coding in said thickness direction configured to indicate that no refilling is required, a second coding following the first, upper coding configured to indicate refilling with a refill stock provided with a refill coding corresponding to the second coding, and at least one further coding configured to indicate refilling with an increasingly thicker refill stock provided with a refill coding corresponding to the respective at least one further coding.

34. A system for optimally filling an apparatus for dispensing a zigzag folded web of towel material, the system comprising:

a holder that is disposed in a housing, for receiving a first stock of zigzag folded web of towel material, which zigzag folded web of towel material, on the one side thereof, runs from the holder to a space of use and, on another side thereof, has an end that is connectable by means of a connecting element with a first free end of a subsequent stock of zigzag folded web of towel material forming a refill stock, wherein the zigzag folded web of towel material has a thickness and a thickness direction oriented from said one side to said another side, and wherein the holder is provided with a fill meter having a division, in the thickness direction of each stock of zigzag folded web of towel material, of at least three areas, each area having its own coding:

a first, upper coding in said thickness direction configured to indicate that no refilling is required, a second coding following the first, upper coding configured to indicate refilling with a refill stock provided with a refill coding corresponding to the second coding, and at least one further coding configured to indicate refilling with an increasingly thicker refill stock provided with a refill coding corresponding to the respective at least one further coding.

* * * * *